United States Patent [19]

Kirstein

[11] Patent Number: 4,536,015

[45] Date of Patent: Aug. 20, 1985

[54] FORGERY-PROOF INFORMATION CARRIER

[75] Inventor: Fritz Kirstein, Cologne, Fed. Rep. of Germany

[73] Assignee: Agfa-Gevaert Aktiengesellschaft, Leverkusen-Bayerwerk, Fed. Rep. of Germany

[21] Appl. No.: 471,882

[22] Filed: Mar. 3, 1983

[30] Foreign Application Priority Data

Mar. 13, 1982 [DE] Fed. Rep. of Germany ..... 3209277

[51] Int. Cl.[3] ..... B42D 15/00; B05D 3/00

[52] U.S. Cl. ..... 283/91; 427/54.1; 283/94; 283/904

[58] Field of Search ..... 283/75, 76, 77, 78, 283/81, 91, 94, 904; 427/54.1

[56] References Cited

U.S. PATENT DOCUMENTS

| | | | |
|---|---|---|---|
| 3,313,052 | 3/1967 | Malster | 283/75 |
| 3,640,009 | 2/1972 | Komiyama | 283/75 |
| 3,827,726 | 8/1974 | McVoy et al. | 283/75 |
| 4,119,361 | 10/1978 | Greenaway | 283/75 |
| 4,133,926 | 1/1979 | Vorrier | 283/75 |
| 4,171,864 | 10/1979 | Jung et al. | 283/75 |
| 4,276,334 | 6/1981 | Sugihara | 283/81 |
| 4,415,612 | 11/1983 | Hall et al. | 283/75 |
| 4,420,174 | 12/1983 | Phelps et al. | 283/75 |
| 4,504,083 | 3/1985 | Devrient et al. | 283/75 |

FOREIGN PATENT DOCUMENTS

| | | |
|---|---|---|
| 2225471 | 12/1972 | Fed. Rep. of Germany . |
| 2630002 | 3/1977 | Fed. Rep. of Germany . |
| 2908742 | 10/1979 | Fed. Rep. of Germany . |
| 1360099 | 3/1964 | France . |
| 2449930 | 2/1980 | France . |
| 2105429 | 9/1979 | United Kingdom . |

*Primary Examiner*—Paul A. Bell
*Assistant Examiner*—Paul M. Heyrana
*Attorney, Agent, or Firm*—Connolly and Hutz

[57] ABSTRACT

An identity card for information is provided by the imprint of security figures on the card or the exposure of features in the data carrier insert. The data carrier may be a photographic silver halide layer of a recording material. In addition to the photograph and data about the owner there is provided a film covering the information carrier with externally applied imprints. The shapes of these external imprints are identical to the security features on the insert and are positioned exactly above said features.

6 Claims, 3 Drawing Figures

FORGERY-PROOF INFORMATION CARRIER

This invention relates to a forgery-proof information carrier, for example an identity card. (ID card), a bank card, a permit card or another corresponding document comprising an insert containing the information, such as data, photographs and security features, and at least one film which covers the information and is firmly joined to the insert.

It is known to provide documents, such as bank notes, securities, permit cards and identity cards (ID cards) or passports with a number of security measures which are supposed to make forgery of these documents impossible.

Examples of such security measures include autotypy or note line print on the document or background lines, as described for example in German Auslegeschrift No. 2,630,002.

The documents mentioned often have visible or tangible water-marks in special papers. The printing inks of the documents can often only be reproduced with difficulty using photographic materials. It is known from British Pat. No. 2,015,429 to provide documents with such reproduction-proof or forgery-proof coloured representations.

It is also known to provide documents, such as ID cards, with passport photo, signatures or fingerprints, and to then weld the documents between films.

In order to prevent passport photos which have been inserted from being exchanged, the insert may be made of a piece of special photographic paper, and the data and passport photo are exposed and then developed on the layers thereof. Moreover, this insert may also be provided with additional line print or autotype, and may be welded between films.

Swiss Pat. No. 4,077,066 discloses an identity card in which water-marks, radioactive or fluorescent marks, and a photographic emulsion layer which is applied to the intermediate layer and bears a passport photo of the card owner are provided. Furthermore, a signature strip which is no longer accessible in the finished identity card, and an embossing stamp applied to the outer cover film are provided. An additional imprint on the card blank in the form of thin wave lines, as in the case of for example bank notes (guilloches), which may be made in different colours, extends the protection against forgeries.

It is also known to apply photographic notes to the documents. Another conventional safety precution is the preparation of one of the inside faces or the surface of the documents using dyes which are only visible using wavelengths in the ultraviolet or infrared range.

This measure and a number of other known types of production of documents have the disadvantage that they do not offer any kind of reliable protection against potential forgers and do not allow a simple and clear establishment of authenticity by humans using simple means. Of course, a combination of a number of safety measures complicates the forgery of such documents, but at the same time, it entails a considerable increase in the cost of the documents. For the most part, the documents also have to be produced using non-standard techniques (special constructions) which are very expensive in the case of small quantities.

The object of the present invention is to provide a forgery-proof information carrier which may be easily identified as genuine and which, while being economical to produce, is very forgery-proof.

Based on an information carrier of the initially-mentioned type, the object is achieved according to the present invention in that the film covering the insert provided with the information has an externally applied imprint, the shapes of which are identical to those of the security features on the insert and are imprinted in an exactly fitting manner over these features.

The stamps which are precisely registered with the security features on the insert and are positioned above them make it possible, in a surprisingly simple manner, to immediately see and detect a forgery of the information carrier after separating the film from the insert. Thus, forgery of the information carrier is virtually impossible.

Processes and tools which are suitable for the production of true-formed and true-fitting prints and stamps are known.

In one specific embodiment, the insert is a photographic recording material which has a substrate of paper or plastics, and the substrate is provided with a value mark print, for example with guilloches and/or with water marks. In this embodiment, the information and a photo of the owner are transferred photographically to the insert. The photographic emulsion on the insert may be a black and white silver halide emulsion for the production of a black and white insert, or a colour emulsion, with which a coloured card may be produced.

The layer which may be developed photographically may either be a daylight-sensitive silver halide emulsion or a daylight-insensitive receiving layer containing developing nuclei for the silver salt diffusion process, so that the insert may be produced in daylight.

The information data may be digital or analog data, or both. It may be read as a clear text and/or as a code and by a machine, which further complicates a forgery.

An advantageous embodiment of the information carrier is distinguished in that additional security features are applied photographically to the insert, for example marks, dots, lines or surfaces and corresponding security features are imprinted into the cover film in a visible, tangible and exactly-fitting manner.

In addition to the different information such as name, date of birth, address, code numbers and other data, each insert has symbols, marks, dots, lines (guilloches) or surfaces which may be black and white or coloured and are fixed once and are applied photographically to the insert. The film for covering the insert has imprints corresponding in position and shape to the security features of the insert. The film is applied with its imprints to the insert in an exactly fitting manner, for example by bonding or welding, such that the imprints are exactly positioned over the exposed security features of the insert.

Another advantageous embodiment of the information carrier is distinguished in that in addition to the photographically applied information, marks, dots, lines or surfaces are printed as security features onto the insert using printing inks for the visible or invisible spectral range and corresponding features are printed into the cover film in a visible, tangible and exactly fitting manner.

Imprinting the security features on the insert using printing ink indeed necessitates another working cycle, but shows considerable advantages in that in so doing it is possible to use printing inks which cannot be reproduced photographically. Colours may be used which may only be recognised in the infrared or ultraviolet ranges, or which show a different colour shade or a different colour in polarized light compared to in normal daylight. In this manner, a forgery may be further complicated and an authenticity test may be made more reliable. Of course, printing inks having different properties may also be applied by repeatedly printing on the insert inks which, for example are visible in the normal spectral range, in addition to inks which are only visible using specific aids. One imprint on the cover film is allocated to each print to ensure against forgery, which imprint is positioned exactly over the imprint on the insert.

If a photographic film is used as the insert, the photographic emulsion of which is cast onto a plastics substrate, then it suffices to provide the side of the insert bearing the information with a cover film which is imprinted corresponding to the security features.

In an advantangeous embodiment, the insert is provided on both sides with cover films and at least one of the sides is imprinted in an exactly fitting manner to the imprint on this side of the insert. Of course, it is also possible to provide both sides of the insert with security features and to imprint both cover films accordingly. In this arrangement, both cover films may be provided with the same or different imprints corresponding to the security features. The bilateral arrangement of the cover films also has the advantage that the information carrier does not bend due to its symmetrical construction, and therefore it is easier to read mechanically.

A particularly advantageous embodiment which complicates forgery even further is distinguished in that the cover films are composite films consisting of at least two films of a different chemical composition, and the stamp extends into each of the films.

A split in the composite film is immediately visible, because the imprints are damaged as a result of this. Also, a split in the information carrier between the composite film or films and the insert leads to ultimate destruction, because the security features cannot be subsequently superimposed again in an exactly covering manner.

Thus, the present invention opens a very reliable and economic door to the production of an information carrier which is extremely forgery-proof. This invention is particularly suitable for the production of identity cards or ID cards, but also for the production of bank cards or permit cards.

One embodiment of the present invention will now be described in more detail, with the help of the accompanying drawings, wherein.

Figure 1:
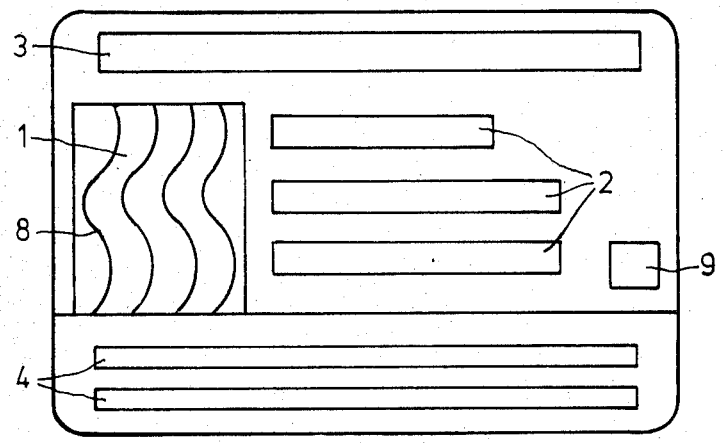
FIG. 1 is a top view of an identity card (ID card)

FIG. 1 illustrates in top view an example of an embodiment of an identity card. The identity card contains one panel 1 for a photograph of the owner, one panel 2 with the details about the owner of the card, such as name, address, date of birth and signature etc., one panel 3 with details about the purpose or the validity of the card and generally one panel 4 for mechanically-legible data. If necessary, the panels 2 to 4 may be positioned such that there is room for a fingerprint. On its surface, the card has imprints 8, the purpose of which will be explained in the following.

Figure 2:
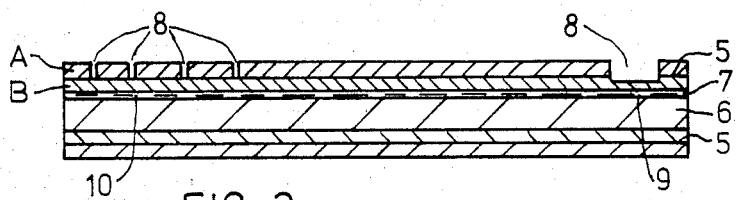
FIG. 2 is a cross-section through the identity card according to FIG. 1.

FIG. 2 illustrates a section through an identity card according to FIG. 1. Accordingly, the card comprises a substrate 6 which supports a photographic silver halide emulsion layer 7. The substrate 6 may be a photographic paper support with or without a plastics covering which, before being covered with the silver halide emulsion layer, is printed like a bank note on one or both sides with a security print (photographic value paper), for example with guilloches, and/or is provided with different water-marks. However, the substrate 6 may also comprise a printed plastics film.

Figure 3:
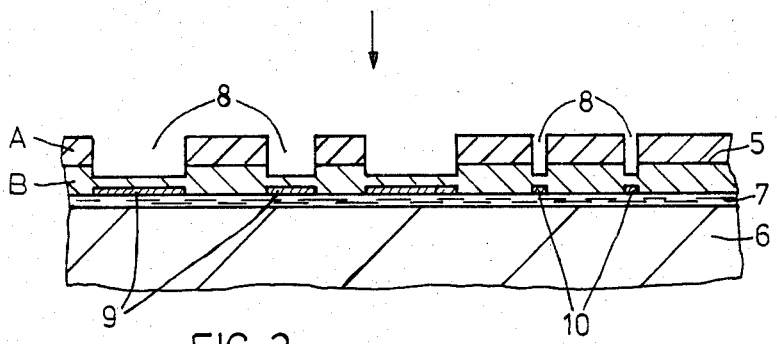
FIG. 3 illustrates a greatly enlarged portion of a cross-section through the identity card.

A photo 1, the details 2 to 4, optionally including a fingerprint, and other security features 9, 10 are exposed on the photosensitive silver halide emulsion layer 7 which is applied to the prepared substrate. The layer is then fixed and, after rinsing, dried. However, the details 3,4 and the security features 9, 10 may also be printed with printing inks before or after exposure and processing (FIG. 3). Conventional printing processes are suitable for the printing operation.

If the photographic layer 7 comprises a daylight-insensitive image receiving layer, then the substrate 6 and the photographic layer 7 may be printed in daylight. The prepared insert 6, 7 is joined in an undetachable manner, at least on the side supporting the photographic layer 7, to a film 5, or (as illustrated in FIG. 2) on both sides to films 5. The joinder is made by laminating using specific adhesives, for example those which contain hardening initiators which may be activated by radiation, by heat or by accelerators and may be hardened in this manner. Such laminates are known, for example from German Auslegeschrift No. 2,952,322. It is impossible to detach the films from the insert when these adhesives are used without destroying the film and the insert.

The undetachable joinder between the films 5 and the insert 6, 7 may also be achieved by welding using pressure and heat, when the films 5 and the surface insert 6, 7 are to be fused together.

Composite films are illustrated in FIG. 2 as films 5 which comprise two films A, B of a different chemical composition. The films A and B may have a colour shade of a slightly different type in order to further complicate a forgery.

FIG. 3 shows an enlarged portion of FIG. 2 with the substrate 6, the photographic layer 7 and a composite film 5 which is firmly joined to the photographic layer 7. Security features 9, 10 are imprinted on the photographic layer 7 which is provided with a photograph 1 and information 2,3,4. The security features may be, for example marks or surfaces 9 or thin lines (guilloches) or dots 10, and are imprinted at specific points on the insert 6, 7 or are distributed over the complete surface of said insert.

The film 5 is provided with imprints 8 at the points corresponding to the printed image 9, 10, so that a similar overlying imprint 8 which exactly corresponds to the printed security feature 9, 10 comes to lie above each printed feature.

The film 5 may be provided with the imprints 8 before it is attached to the insert 6, 7, and then applied onto the insert 6, 7 in an exactly fitting manner.

However, the imprints 8 may also be provided after the films 5 have been applied, in which case the information carrier is supplied in a true-fitting manner to the stamping tool.

In this arrangement, the stamping operation is carried out from above in the direction of the arrow to such a depth that both films A and B of the composite film 5 receive an imprint 8. The imprint extends through film A into film B. Therefore, any attempt to split the composite film 5 is immediately apparent.

Due to the imprint pattern 8 of the films A and B which is identical to the pattern printed on the insert 6,7, it is immediately possible to detect a separation of the film B from the insert 6, 7, and such an attempt cannot subsequently be repaired.

Not only opaque but also transparent inks may be used as printing inks in order to optionally facilitate the legibility of the information carrier. Likewise, it is possible to use inks which cannot be recognised in the visible spectral range without aids. In general, it is possible to use conventional pigmented printing inks.

Instead of imprinting the security features, it is also possible to provide the photographic layer of the insert with a background pattern by suitable exposure and development, and/or marks thin lines or dots, which, for example, may be exposed and conform with the imprints applied to the film (FIG. 2).

I claim:

1. An information carrier comprising an information-carrying sheet-like insert security features imprinted in ink on at least one surface of said insert, said ink having a visible spectral range and including ink which may become visible with an aid, a pair of films each covering one of the respective plane surfaces of the insert and firmly joined thereto and at least one of said covering films having an externally applied imprint impressed on the outer surface of the film in identical shape correspondence to security features for overlying the security feature with an imprint exactly positioned over the security feature.

2. An information carrier according to claim 1, characterised in that the information data are digital and/or analog data.

3. An information carrier according to claim 1, characterised in that additional security features are applied photographically to the insert and the imprint is visibly imprinted into the cover film in an exactly fitting manner to the exposure.

4. An information carrier according to claim 1, characterised in that the films are composite films comprising at least two films A and B of a different chemical composition, and the imprint extends into each of the films (A, B).

5. An information carrier comprising an information-carrying sheet-like insert security features applied photographically on at least one surface of said insert, said photographic feature having a visible spectral range and including a feature which may become visible with an aid, a pair of films each covering one of the respective plane surfaces of the insert and firmly joined thereto and at least one of said covering films having an externally applied imprint impressed on the outer surface of the film in identical shape correspondence to security feature for overlying the security feature with an imprint exactly positioned over the security feature.

6. An information carrier as claimed in claim 5, wherein said photographically-produced feature is a photograph of the owner.

* * * * *